US008559651B2

(12) United States Patent
DeLuca

(10) Patent No.: US 8,559,651 B2
(45) Date of Patent: Oct. 15, 2013

(54) SYNTHETIC STEREO ON A MONO HEADSET WITH MOTION SENSING

(75) Inventor: Michael Joseph DeLuca, Boca Raton, FL (US)

(73) Assignee: BlackBerry Limited, Waterloo (CA)

( * ) Notice: Subject to any disclaimer, the term of this patent is extended or adjusted under 35 U.S.C. 154(b) by 403 days.

(21) Appl. No.: 13/046,351

(22) Filed: Mar. 11, 2011

(65) Prior Publication Data

US 2012/0230507 A1 Sep. 13, 2012

(51) Int. Cl.
*H04R 1/10* (2006.01)

(52) U.S. Cl.
USPC ..... 381/74; 381/104; 381/119

(58) Field of Classification Search
USPC ..... 381/1–17, 309–311, 58–59, 77–85, 74, 381/87, 332–334, 104–109, 119; 700/94
See application file for complete search history.

(56) References Cited

U.S. PATENT DOCUMENTS

| | | | | |
|---|---|---|---|---|
| 7,590,233 | B2 * | 9/2009 | Chiloyan | 379/430 |
| 7,734,055 | B2 * | 6/2010 | Chiloyan | 381/309 |
| 8,085,920 | B1 * | 12/2011 | Bedingfield et al. | 379/202.01 |
| 2003/0061001 | A1 | 3/2003 | Willins et al. | |
| 2006/0251277 | A1 | 11/2006 | Cho | |
| 2007/0287380 | A1 | 12/2007 | Hui et al. | |
| 2008/0132798 | A1 | 6/2008 | Hong et al. | |
| 2009/0154720 | A1 * | 6/2009 | Oki | 381/74 |
| 2009/0219224 | A1 | 9/2009 | Elg | |
| 2010/0020982 | A1 * | 1/2010 | Brown et al. | 381/74 |

FOREIGN PATENT DOCUMENTS

| | | | |
|---|---|---|---|
| WO | 20050032209 | A2 | 4/2005 |
| WO | 2010092524 | A2 | 8/2010 |

OTHER PUBLICATIONS

Apple Insider—Apple investigating advanced displays, motion sensing headset. pp. 1-5- Retrieved Jan. 28, 2010.
MH907—The worlds first motion sensing headset. http://www.ciol.com/Technology/Mobility/News-Reports/MH907-The-worlds-first-motion-sensingheadset/ 29909125621/0/. Retrieved Sep. 29, 2009.
Scan Sound—Single Earbud Stereo Sound—http://www.scansound.com/single-stereo-earbud.htm.
Jabra BT8010 Stereo/Mono Bluetooth Headset—http://www.zimbio.com/Bluetooth+Headsets/articles/VPCi-MBilhA/Jabra+BT8010+Stereo+Mono+Bluetooth+Headset. Written on Jul. 5, 2010.
Various audio editor software—How to convert mono to stereo. http://www.selected-audio-reviews.com/articlepages/howto/how_to_convert_mono_to_stereo.htm. Retrieved Jan. 18, 2012.
Extended European Search report mailed Jul. 19, 2011. In corresponding application No. 11157964.5.

* cited by examiner

*Primary Examiner* — Vivian Chin
*Assistant Examiner* — Fatimat O Olaniran
(74) *Attorney, Agent, or Firm* — Novak Druce Connolly Bove + Quigg LLP

(57) ABSTRACT

A system, processor implemented method, and non-transitory computer readable medium for playing a synthetic stereo on a mono headset with motion sensing. The method comprises a processor receiving movement data from an accelerometer detecting movement of the mono headset. In response to receiving movement data, the processor mixing an output audio signal comprising a left channel signal and a right channel signal and providing the output audio signal comprising a combination of the left channel signal and right channel signal based at least in part on detected movement of the mono headset. The output audio signal having either a substantially equal or unequal combination of the left channel signal and right channel signal based at least in part on detected movement of the mono headset.

17 Claims, 7 Drawing Sheets

SYNTHETIC STEREO ON A MONO HEADSET WITH MOTION SENSING

FIELD OF TECHNOLOGY

The instant disclosure relates generally to playing synthetic stereo on a mono headset with motion sensing. More specifically, the instant disclosure relates to a wireless headset that adjusts the balance of a left channel signal and a right channel signal based on detected motion of the wireless headset.

BACKGROUND

Users are becoming more dependent on their mobile devices. For convenience and for legal purposes, many users may use headsets when talking on their mobile devices. For example, many users may wear a wireless headset in one ear, such as a Bluetooth® headset. When not using the wireless headset for phone calls, the user may listen to music via the wireless headset. Although the music content may originate as a stereo signal, for example, having a left channel signal for a left speaker and a right channel signal for a right speaker, the wireless headset is a single speaker, thus the user may not be able to appreciate full fidelity of the music. In contrast, if the user uses a stereo headset, for example a headset having a speaker for the left ear and another speaker for the right ear, the user could hear the music in stereo with each speaker receiving different music or content. As a result, the stereo headset can provide dimensional sound.

BRIEF DESCRIPTION OF THE DRAWINGS

Implementations of the instant disclosure will now be described, by way of example only, with reference to the attached Figures, wherein.

DETAILED DESCRIPTION

Figure 1:
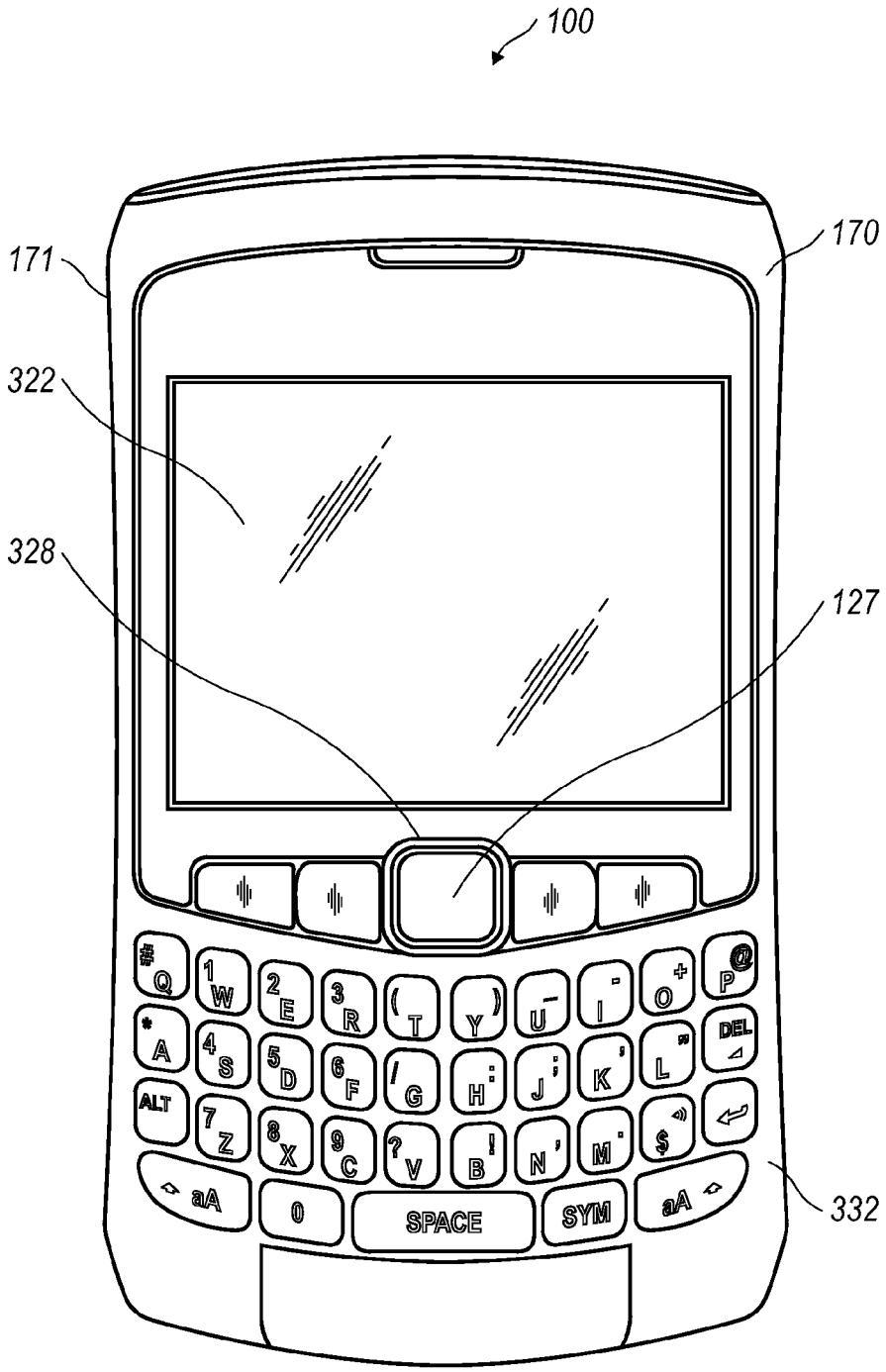
FIG. 1 is a front view of a mobile device having a physical keyboard in accordance with an exemplary implementation.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, methods, procedures and components have not been described in detail so as not to obscure the embodiments described herein. Also, the description is not to be considered as limiting the scope of the embodiments described herein. The following description uses the term "signal" or "signals," however the term signal can be referred to as a "component". For example, the output audio signal can be an output audio component. In another example, the left channel signal can be a left channel component and the right channel signal can be a right channel component.

Several definitions that apply throughout this disclosure will now be presented. The word "coupled" is defined as connected, whether directly or indirectly through intervening components, and is not necessarily limited to physical connections. The term "communicatively coupled" is defined as connected, whether directly or indirectly through intervening components, is not necessarily limited to a physical connection, and allows for the transfer of data. The term "mobile device" is defined as any mobile device that is capable of at least accepting information entries from a user and includes the device's own power source. A "wireless communication" means communication that occurs without wires using electromagnetic radiation. The term "memory" refers to transitory memory and non-transitory memory. For example, non-transitory memory can be implemented as Random Access Memory (RAM), Read-Only Memory (ROM), flash, ferromagnetic, phase-change memory, and other non-transitory memory technologies. The term "mobile device" refers to a handheld wireless communication device, handheld wired communication device, personal digital assistant (PDA), cellular phone, smart phone, MP3 or other music player, or any other device that is capable of communicating stereophonic audio content to a headset.

Figure 2:
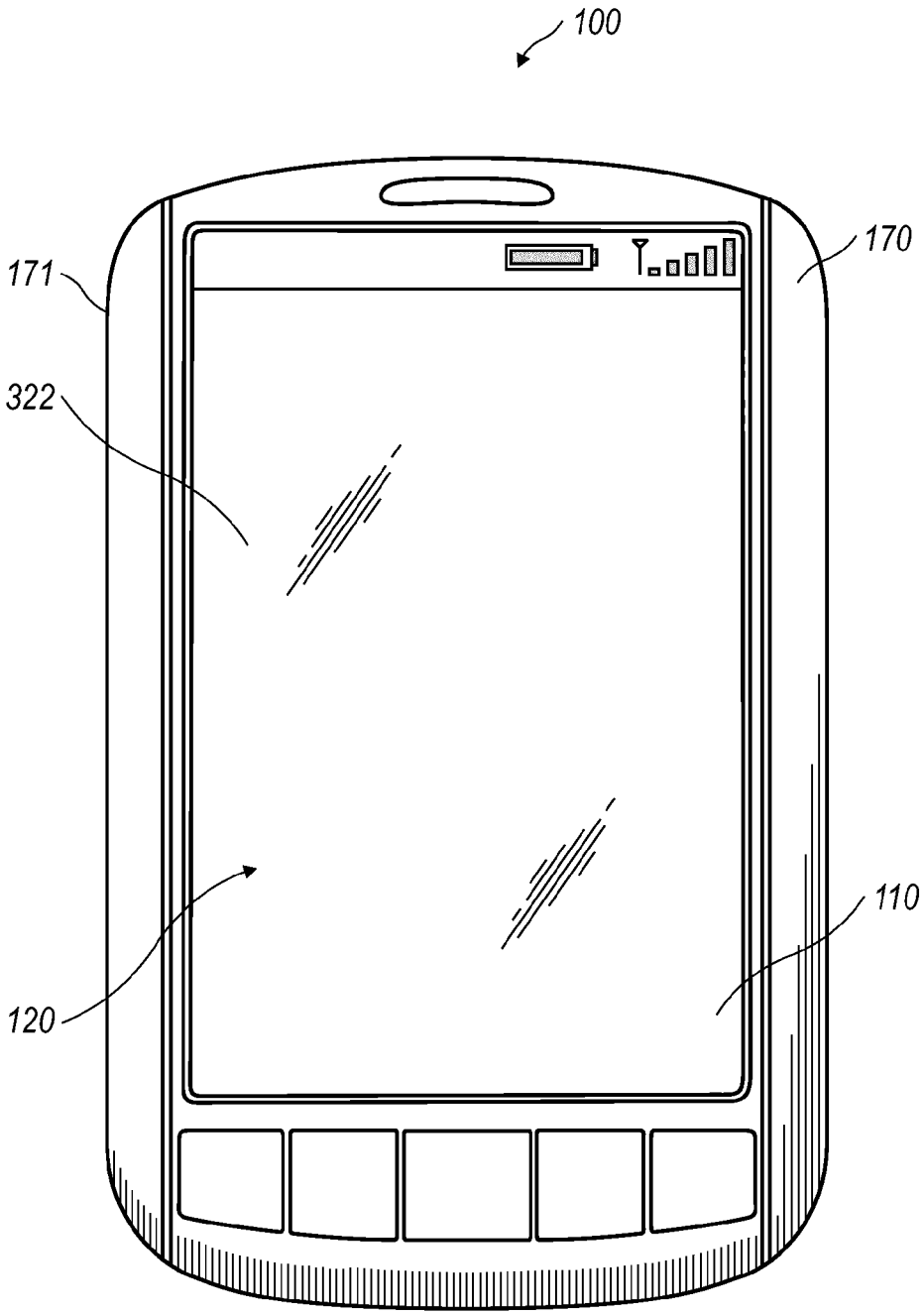
FIG. 2 is a front view of a mobile device having a touch-sensitive display in accordance with an exemplary implementation.

Referring to FIGS. 1 and 2, front views of a mobile device having a keyboard and a mobile device having a touch-sensitive display in accordance with exemplary implementations are illustrated, respectively. The exemplary embodiments depicted in the figures are provided for illustration purposes and those persons skilled in the art will appreciate that the mobile devices 100 can include additional elements and modifications necessary to make the mobile device 100 operable in particular network environments.

As shown in FIG. 1, the mobile device 100 can include a body 171 housing a lighted display 322, a navigational tool (auxiliary input) 328 and a keyboard 332 suitable for accommodating textual input. The mobile device 100 of FIG. 1 can be a unibody construction, but common "clamshell" or "flip-phone" constructions are also suitable for the embodiments disclosed herein. The display 322 can be located above the keyboard 332. The navigational tool (auxiliary input) 328, such as an optical navigational pad 127, can be located essentially between the display 322 and the keyboard 332 on a front face 170. The keyboard 332 can comprise a plurality of keys with which alphabetic letters are associated, but at least a portion of the individual keys have multiple letters associated therewith. This type of configuration is referred to as a reduced keyboard (in comparison to the full keyboard described immediately above) and can, among others come in QWERTY, QWERTZ, AZERTY, and Dvorak layouts.

As shown in FIG. 2, the mobile device 100 can include a body 171 housing a display 322, touch location sensor 110 and a transparent cover lens 120 on a front face 170. In at least one embodiment, the touch location sensor 110 can be provided on a portion of the display 322. In other embodiments, the touch location sensor 110 can be a separate component that is provided as part of the touch-sensitive display 322. As illustrated, the touch location sensor 110 can be shown as located above the display 322, but in other embodiments the touch location sensor 110 can be located below the display 322. The touch location sensor 110 can be a capacitive, resistive or other touch sensitive sensor. The display 322 can be a liquid crystal display (LCD) or a light emitting diode (LED) display. It is also contemplated within this disclosure that the display 322 can be another type of device which is capable of visually displaying information.

Figure 3:
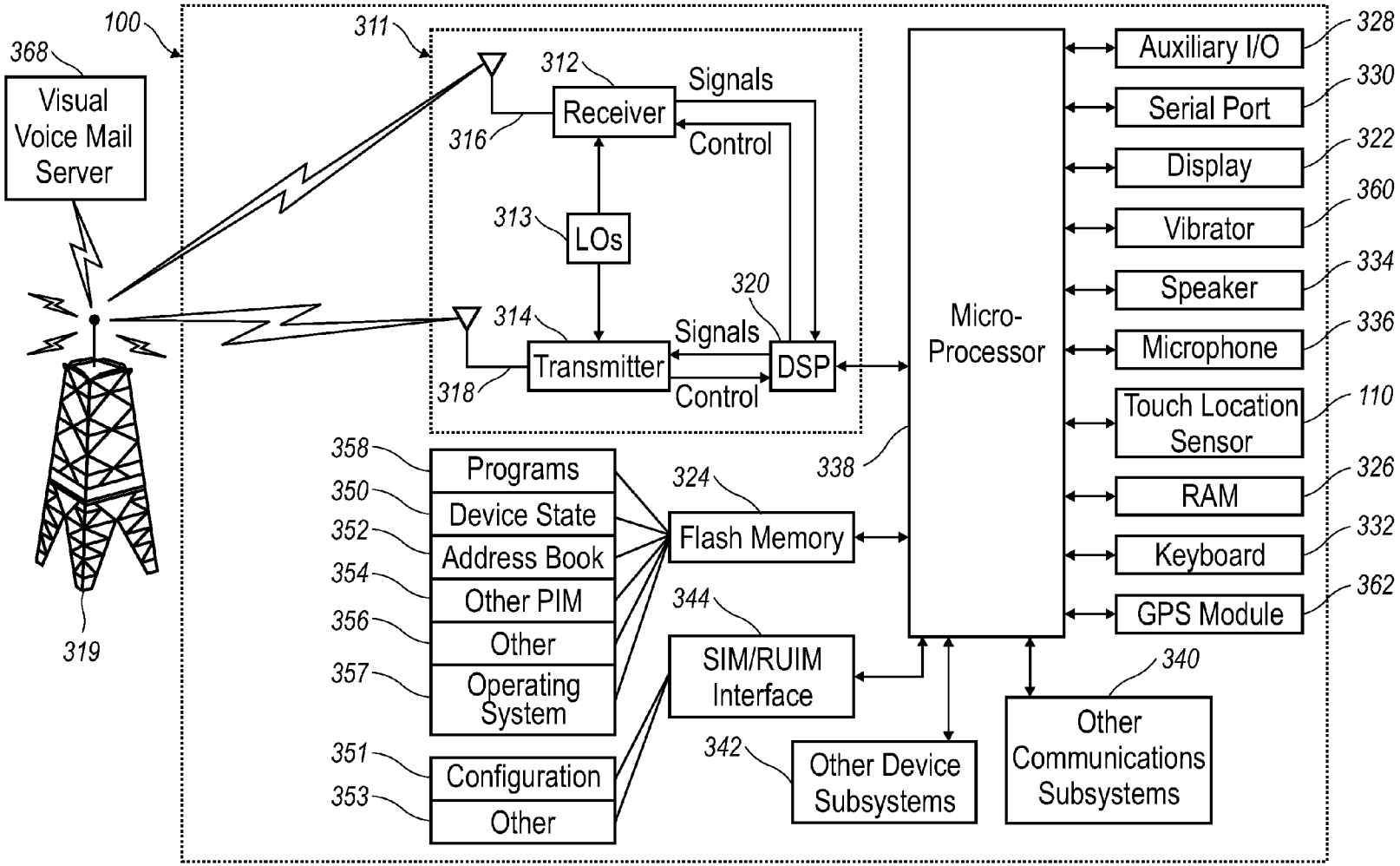
FIG. 3 a block diagram representing a mobile device interacting in a communication network in accordance with an exemplary implementation.

Referring to FIG. 3, a block diagram representing a mobile device interacting in a communication network in accordance with an exemplary implementation is illustrated. As shown, the mobile device 100 can include a processor or microprocessor 338 (hereinafter a "processor") that controls the operation of the mobile device 100. A communication subsystem 311 can perform all communication transmission and reception with the wireless network 319. The processor 338 can be communicatively coupled to an auxiliary input/output (I/O) subsystem 328 which can be communicatively coupled to the mobile device 100. Additionally, in at least one embodiment, the processor 338 can be communicatively coupled to a serial port (for example, a Universal Serial Bus port) 330 that facilitates communication with other devices or systems via the serial port 330. A display 322 can be communicatively coupled to processor 338 to display information to an operator of the mobile device 100. When the mobile device 100 is equipped with a keyboard 332, which may be physical or virtual, the keyboard 332 can be communicatively coupled to the processor 338. The mobile device 100 can include a speaker 334, a microphone 336, random access memory 326 (RAM), and flash memory 324, all of which may be communicatively coupled to the processor 338.

Additionally, a vibrator 360 comprising a vibrator motor can be communicatively coupled to the processor 338. The vibrator 360 can generate vibrations in the mobile device 100. The mobile device 100 can include a global positioning system (GPS) module 362 communicatively coupled to the processor 338. The GPS module 362 can acquire the GPS data for a mobile device 100. The GPS data can include, but not limited to, GPS coordinates of the mobile device 100, geo-location of the mobile device 100 or both. The GPS coordinates can include the latitude and longitude coordinates for the mobile device 100. The geo-location can include a street address for the mobile address, e.g., 123 Main Street. In one or more embodiments, the GPS module 362 can acquire the GPS data of the mobile device 100 using satellites, determining the closest cell tower, triangulation based on three or more cell towers, or other known methods for determining the location of the mobile device 100. The mobile device 100 can include other similar components that are optionally communicatively coupled to the processor 338. Other communication subsystems 340 and other device subsystems 342 can be generally indicated as being communicatively coupled to the processor 338. An example of a communication subsystem 340 is a short range communication system such as BLUETOOTH® communication module or a WI-FI® communication module (a communication module in compliance with IEEE 802.11b). These subsystems 340, 342 and their associated circuits and components can be communicatively coupled to the processor 338. Additionally, the processor 338 can perform operating system functions and can enable execution of programs on the mobile device 100. In some embodiments the mobile device 100 does not include all of the above components. For example, in at least one embodiment the keyboard 332 is not provided as a separate component and can be integrated with a touch-sensitive display 322 as described below.

Furthermore, the mobile device 100 can be equipped with components to enable operation of various programs. In an exemplary embodiment, the flash memory 324 can be enabled to provide a storage location for the operating system 357, device programs 358, and data. The operating system 357 can be generally configured to manage other programs 358 that are also stored in memory 324 and executable on the processor 338. The operating system 357 can honor requests for services made by programs 358 through predefined program interfaces. More specifically, the operating system 357 can determine the order in which multiple programs 358 are executed on the processor 338 and the execution time allotted for each program 358, manages the sharing of memory 324 among multiple programs 358, handles input and output to and from other device subsystems 342, and so on. In addition, operators can typically interact directly with the operating system 357 through a user interface usually including the display screen 322 and keyboard 332. While in an exemplary embodiment the operating system 357 can be stored in flash memory 324, the operating system 357 in other embodiments is stored in read-only memory (ROM) or similar storage element (not shown). As those skilled in the art will appreciate, the operating system 357, device program 358 or parts thereof can be loaded in RAM 326 or other volatile memory. In one exemplary embodiment, the flash memory 324 can contain programs 358 for execution on the mobile device 100 including an address book 352, a personal information manager (PIM) 354, and the device state 350. Furthermore, programs 358 and other information 356 including data can be segregated upon storage in the flash memory 324 of the mobile device 100.

When the mobile device 100 is enabled for two-way communication within the wireless communication network 319, the mobile device 100 can send and receives signal from a mobile communication service. Examples of communication systems enabled for two-way communication can include, but are not limited to, the General Packet Radio Service (GPRS) network, the Universal Mobile Telecommunication Service (UMTS) network, the Enhanced Data for Global Evolution (EDGE) network, the Code Division Multiple Access (CDMA) network, High-Speed Packet Access (HSPA) networks, Universal Mobile Telecommunication Service Time Division Duplexing (UMTS-TDD), Ultra Mobile Broadband (UMB) networks, Worldwide Interoperability for Microwave Access (WiMAX), and other networks that can be used for data and voice, or just data or voice. For the systems listed above, the mobile device 100 can require a unique identifier to enable the mobile device 100 to transmit and receive signals from the communication network 319. Other systems may not require such identifying information. GPRS, UMTS, and EDGE use a Subscriber Identity Module (SIM) in order to allow communication with the communication network 319. Likewise, most CDMA systems can use a Removable User Identity Module (RUIM) in order to communicate with the CDMA network. The RUIM and SIM card can be used in a multitude of different mobile devices 100. The mobile device 100 can operate some features without a SIM/RUIM card, but a SIM/RUIM card is necessary for communication with the network 319. A SIM/RUIM interface 344 located within the mobile device 100 can allow for removal or insertion of a SIM/RUIM card (not shown). The SIM/RUIM card can feature memory and holds key configurations 351, and other information 353 such as identification and subscriber related information. With a properly enabled mobile device 100, two-way communication between the mobile device 100 and communication network 319 can be possible.

If the mobile device 100 is enabled as described above or the communication network 319 does not require such enablement, the two-way communication enabled mobile device 100 is able to both transmit and receive information from the communication network 319. The transfer of communication can be from the mobile device 100 or to the mobile device 100. In order to communicate with the communication network 319, the mobile device 100 in the presently described exemplary embodiment can be equipped with an integral or internal antenna 318 for transmitting signals to the communication network 319. Likewise the mobile device 100 in the presently described exemplary embodiment can be equipped with another antenna 316 for receiving communication from the communication network 319. These antennae (316, 318) in another exemplary embodiment can be combined into a single antenna (not shown). As one skilled in the art would appreciate, the antenna or antennae (316, 318) in another embodiment can be externally mounted on the mobile device 100.

When equipped for two-way communication, the mobile device 100 can include a communication subsystem 311. As is understood in the art, this communication subsystem 311 can support the operational needs of the mobile device 100. The subsystem 311 can include a transmitter 314 and receiver 312 including the associated antenna or antennae (316, 318) as described above, local oscillators (LOs) 313, and a processing module 320 which in the presently described exemplary embodiment can be a digital signal processor (DSP) 320.

Communication by the mobile device 100 with the wireless network 319 can be any type of communication that both the wireless network 319 and mobile device 100 are enabled to transmit, receive and process. In general, these can be classified as voice and data. Voice communication generally refers to communication in which signals for audible sounds are transmitted by the mobile device 100 through the communication network 319. Data generally refers to all other types of communication that the mobile device 100 is capable of performing within the constraints of the wireless network 319.

While the above description generally describes the systems and components associated with a handheld mobile device, the mobile device 100 can be another communication device such as a PDA, a laptop computer, desktop computer, a server, or other communication device. In those embodiments, different components of the above system might be omitted in order provide the desired mobile device 100. Additionally, other components not described above may be required to allow the mobile device 100 to function in a desired fashion. The above description provides only general components and additional components can be required to enable system functionality. These systems and components would be appreciated by those of ordinary skill in the art.

Auxiliary I/O subsystem 328 comes in a variety of different forms including a navigational tool 328. Navigational tools can include one or more optical navigational pads, rotatable thumb wheels, joysticks, touchpads, four-way cursors, trackball based devices and the like. The preferred embodiment of the navigational tool 328 is an optical navigational based device. Other auxiliary I/O subsystems capable of providing input or receiving output from the handheld mobile device 100 such as external display devices and externally connected keyboards (not shown) can be considered within the scope of this disclosure.

Figure 4:
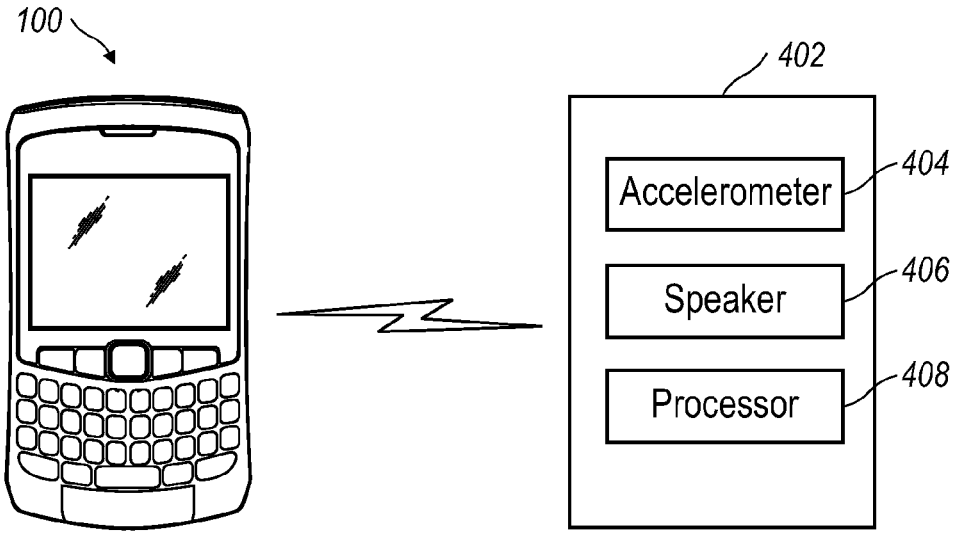
FIG. 4 is a block diagram representing a mobile device communicatively coupled with a wireless headset in accordance with an exemplary implementation.

Referring to FIG. 4, a block diagram representing a mobile device communicatively coupled with a wireless headset in accordance with an exemplary implementation is illustrated. As shown, a mobile device 100 can be communicatively coupled to a wireless headset 402, such as a Bluetooth® device. The mobile device 100 can send one or more audio signals to the wireless headset 402. In one or more embodiments, a wired headset (not shown) can be implemented. The wireless headset 402 can include an accelerometer 404, a single speaker 406, and a processor 408 or microprocessor. The accelerometer 404 can detect movement of the wireless headset 402. The detected movement can be movement of the wireless headset 402 to the left and to the right. Movement to the left can be referred to as counter clockwise ("CCW") movement and movement to the right can be referred to as clockwise ("CW") movement. The single speaker 406 can reproduce audio in response to receiving an output audio signal from the processor 408. The wireless headset 402 can be referred to as a mono wireless headset 402.

The processor 408 can be communicatively coupled to the accelerometer 404 and the single speaker 406. The processor 408 can be configured to receive the one or more audio signals, for example, a stereophonic input audio signal, from the mobile device 100 and mix an output audio signal based on the stereophonic input audio signal. The stereophonic input audio signal can include a left channel signal and a right channel signal. The output audio signal can comprise a left channel signal and a right channel signal and provide an output audio signal to the single speaker. The output audio signal can comprise an audio signal having a left channel signal and a right channel signal. The left channel signal and right channel signal can include different audio signals. For example, the left channel signal can include proportionally more audio signals for the main vocals and audio signals from acoustic instruments and the right channel signal can include proportionally more audio signals for backup vocals and audio signals from percussion instruments which thereby produce a stereoscopic listening effect as if played through a stereo speaker system. The processor 408 can set or mix the output audio signal comprising a combination of the left channel signal and right channel signal based at least in part on detected movement detected by the accelerometer 404. The processor 408 can set the balance of the left channel signal and right channel signal of the output audio signal based on the magnitude, direction and duration of the detected movement by the accelerometer 404. In one or more embodiments, the processor 338 of the mobile device 100 can be communicatively coupled to the accelerometer 404 and single speaker 406 of the wireless headset 402 and can perform one or more functions of the processor 408 of the wireless headset 402.

When the wireless headset 402 is not being moved, the output audio signal can be set to have a substantially equal balance such as 50% left channel signal and 50% right channel signal. When the wireless headset 402 moves in one direction, the processor 308 can change the balance of the output audio signal. For example, if the wireless headset 402 is moved clockwise or to the right, the output audio signal can reach 100% left channel signal and 0% right channel signal and if the wireless headset 402 is moved counter clockwise or to the left, the output audio signal can reach 0% left channel signal and 100% right channel signal. This gives a perception of stereo sound in response to the movement of the wireless headset 402 even though there is only a single speaker played into one ear of the listener. Once the movement of the wireless headset 402 stops, the balance of the output audio signal can decay back to a 50% left channel signal and a 50% right channel signal. In the described embodiment, the balance of the left channel signal and right channel signal can change gradually based on the magnitude, direction and duration of the movement and can return to 50% left channel signal and 50% right channel signal in a decaying manner once the detected movement ceases. In one or more embodiment, the change of the balance can be done in different manners. For example, once the detected movement ceases, the balance can shift immediately to 50% left channel signal and 50% right channel signal. In one or more embodiments, the amount of detected movement can be compared to a threshold and in the event the detected movement exceeds the threshold, the balance of the left channel signal and right channel signal can be set or adjusted based on the detected movement. For example, the processor 408 can compare the detected movement with a preset threshold and if the detected movement exceeds the present threshold, the balance of the left channel signal and the right channel signal can be set or adjusted. In the event the detected movement does not exceed the preset threshold, the balance of the left channel signal and right channel signal can remain substantially equal.

Figure 5:
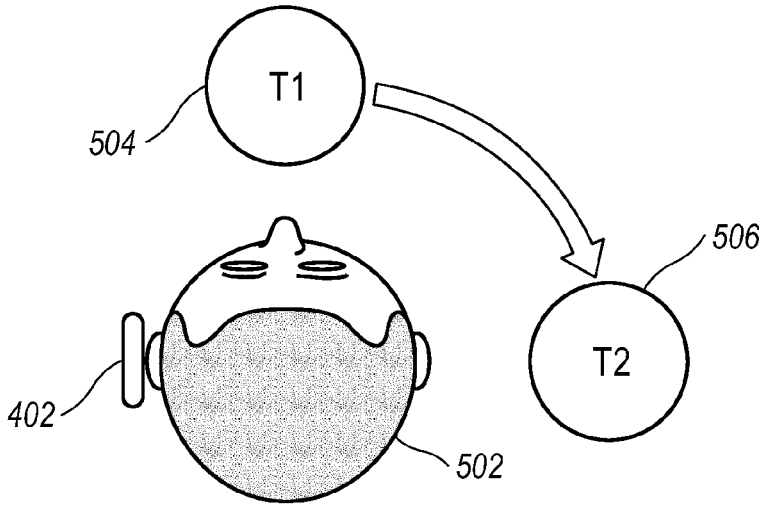
FIG. 5 is a block diagram of detected movement of a wireless headset in accordance with a first exemplary implementation.
Figure 6:
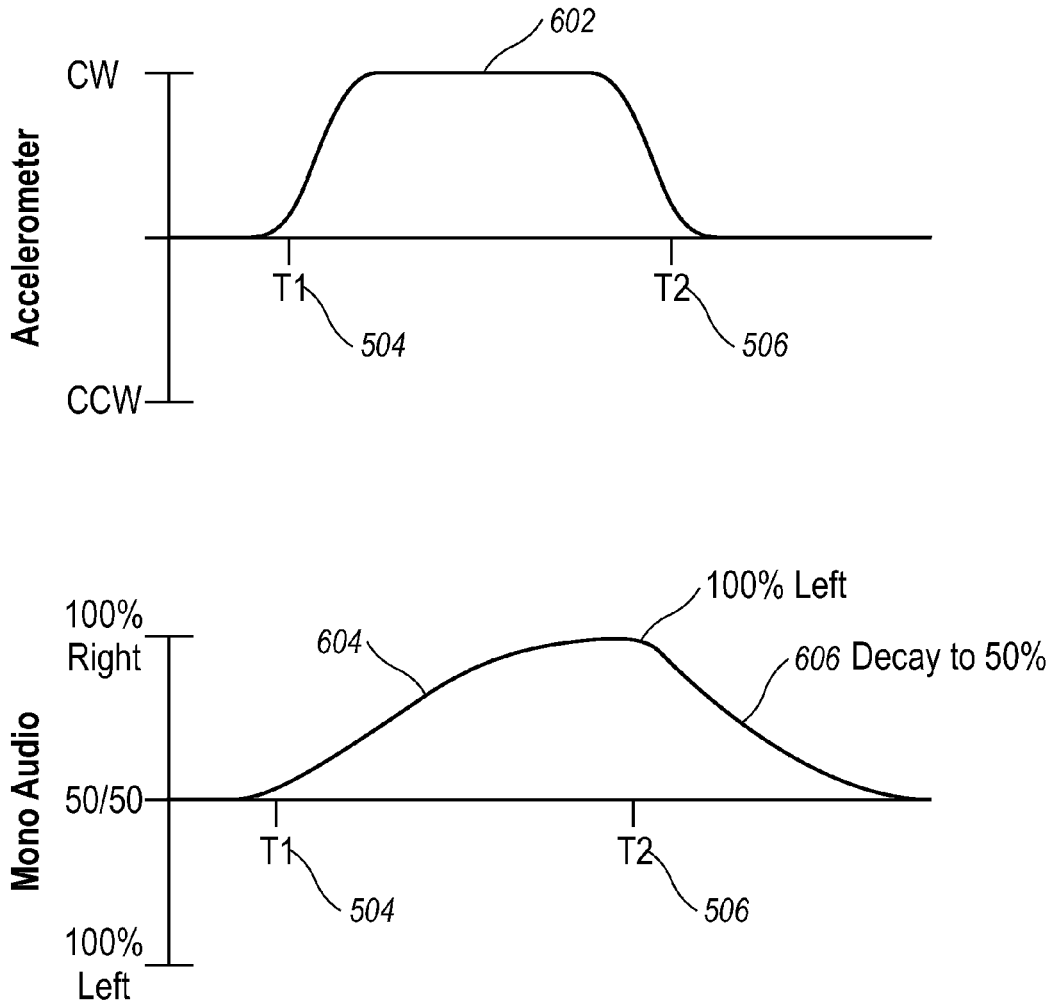
FIG. 6 is time graphs showing detected movement of an accelerometer and the output audio signal of the headset corresponding to the detected movement in accordance with a first exemplary implementation.

Referring to FIGS. 5 and 6, a block diagram of the detected movement of a wireless headset and corresponding time graphs in accordance with a first exemplary implementation are illustrated. As shown in this example, a user 502 having a wireless headset 402 is looking straight ahead at time T1 504 and rotates his or her head CW to the right until time T2 506. Due to the detected movement 602 of the wireless headset 402, the output audio signal 604 changes. For example, when the user is looking straight ahead, the output audio signal 604 can be substantially equal or balanced: 50% left channel signal and 50% right channel signal. When the wireless headset 402 moves clockwise, the balance of the left channel signal and right channel signal in the output audio signal 604 can change. For example, when the detected movement 602 of the wireless headset 402 is first detected by the accelerometer 404, the balance of the left channel signal and right channel signal in the output audio signal 604 can change to have more right channel signal compared to the left channel signal. When the detected movement 602 stops at T2, the balance of the left channel signal and right channel signal in the output audio signal 604 can return to an equal balance of the left channel signal and right channel signal. As shown in FIG. 6, the processor 408 can set or change the balance in a gradual manner due to a constant magnitude of the detected movement, for example, 50% left channel signal and 50% right channel signal, then 45% left channel signal and 55% right channel signal, then 40% left channel signal and 60% right channel signal, until the balance is substantially 100% left channel signal and 0% right channel signal. Thus as the user's head turns to the right, the content of the right channel is emphasized relative to the content of the left channel. When the detected movement 602 stops at time T2, the balance of the output audio signal 604 can return to 50% left channel signal and 50% right channel signal in a decaying manner. As can be appreciated in other embodiments, the left channel and right channel can be interchanged while remaining within the scope of this disclosure.

Figure 7:
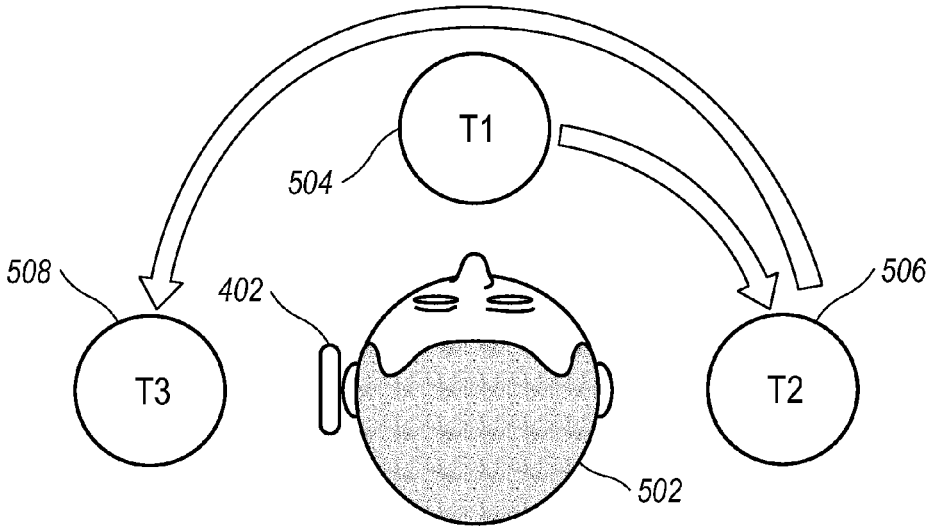
FIG. 7 is a block diagram of detected movement of a wireless headset in accordance with a second exemplary implementation.
Figure 8:
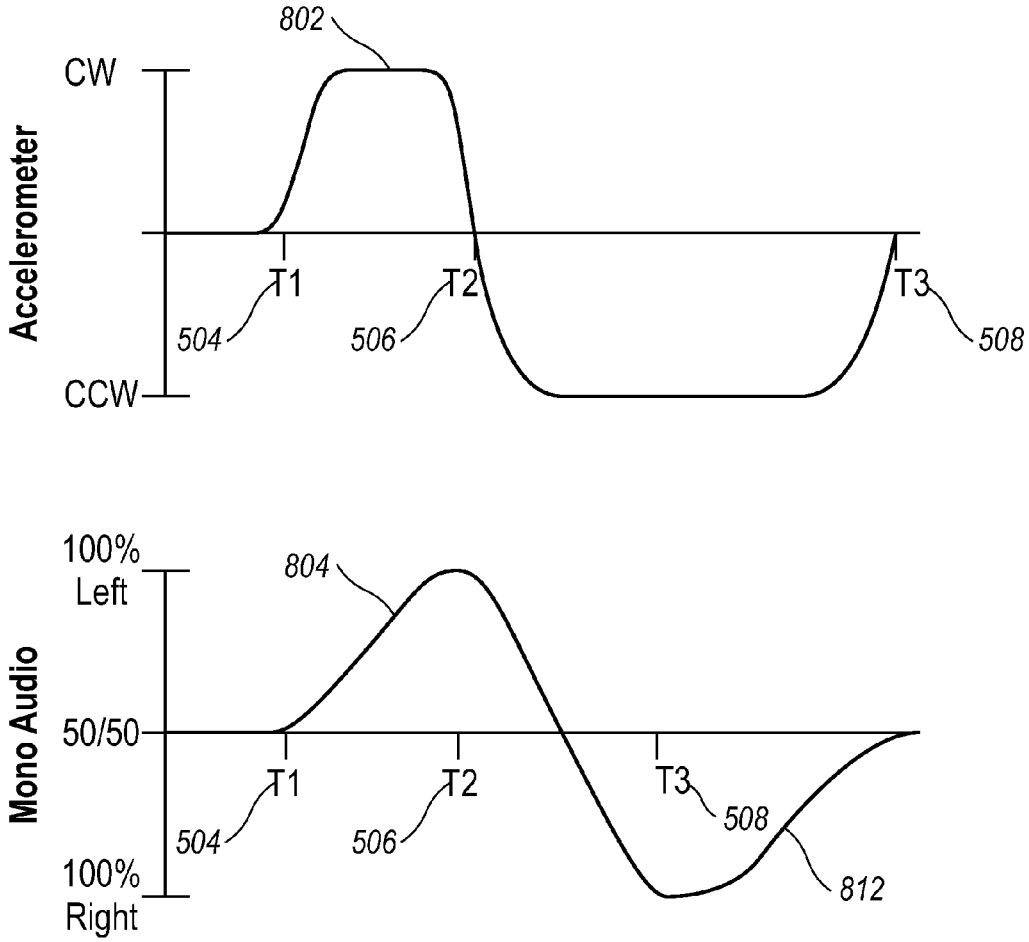
FIG. 8 is time graphs showing detected movement of an accelerometer and the output audio signal of the headset corresponding to the detected movement in accordance with a second exemplary implementation.

Referring to FIGS. 7 and 8, a block diagram of the detected movement of a wireless headset and corresponding time graphs in accordance with a second exemplary implementation are illustrated. Note that the time graphs of FIGS. 6 and 8 are not necessarily to scale. As shown in this example, a user 502 having a wireless headset 402 is looking straight ahead at time T1 504, rotates his or her head CW to the right until time T2 506, and then rotates his or her head to the left until time T3 508. As a result, the output audio signal can change from 50% left channel signal and 50% right channel signal at T1 504. When the accelerometer 404 detects movement 802, the balance of the left channel signal and right channel signal can be adjusted. For example, the left channel signal can change from 50% to 100% and the right channel signal can change from 50% to 0%. In this example, as the user's head turns to the right, the content of the left channel is emphasized relative to the content of the right channel. The change can be gradual or any other function of the magnitude, direction, and duration of the detected movement. At T2 506, the balance of the output audio signal 804 can return to 50% left channel signal and 50% right channel signal in a decaying 806 manner as shown in FIG. 6. However, after T2 506, a second movement of the headset 402 is detected. When the accelerometer 404 detects movement 802, the balance of the left channel signal and right channel signal can change. For example, the left channel signal can change from 100% to 0% and the right channel signal can change from 0% to 100%. The change can be gradual based on the magnitude, direction and duration of the detected movement. At T3 508, the balance of the output audio signal 804 can return to 50% left channel signal and 50% right channel signal.

Figure 9:
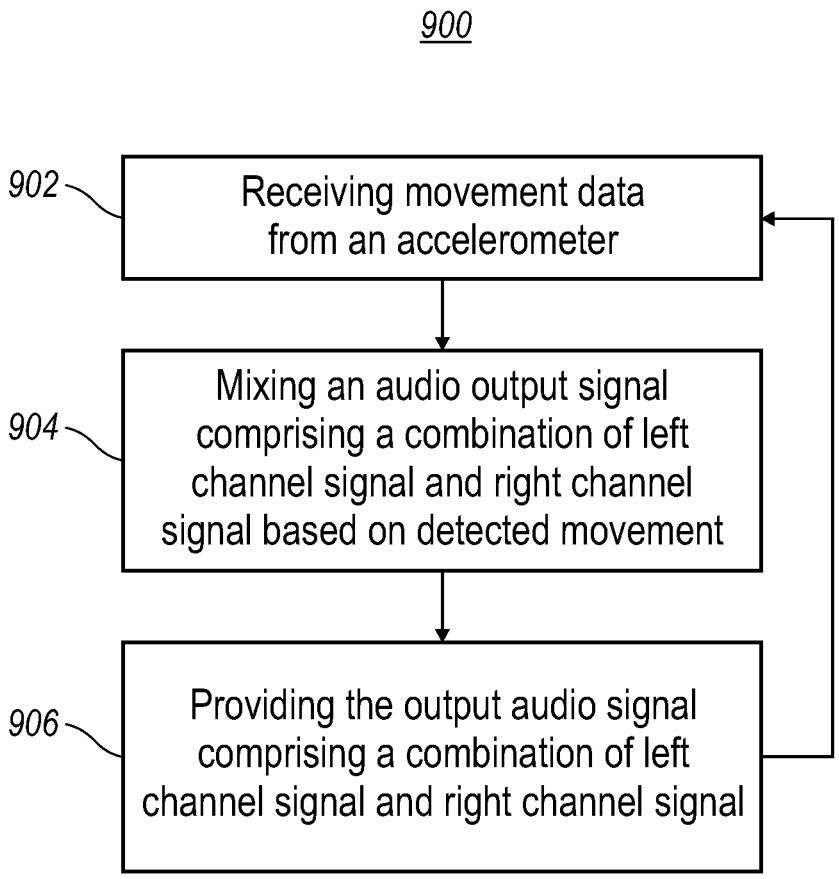
FIG. 9 is a flowchart for a method for providing an output audio signal for a wireless headset in accordance with an exemplary implementation.

Referring to FIG. 9, a flowchart for a method for providing an output audio signal for a wireless headset in accordance with an exemplary implementation. The exemplary method 900 is provided by way of example, as there are a variety of ways to carry out the method. The method 900 described below can be carried out using the mobile device 100 and wireless headset shown in FIG. 4 by way of example, and various elements of these figures are referenced in explaining exemplary method 900. Each block shown in FIG. 9 represents one or more processes, methods or subroutines, carried out in exemplary method 900. The exemplary method 900 may begin at block 902.

At block 902, movement data from an accelerometer can be received. For example, the processor 408 can receive movement data from the accelerometer 404. In the event the wireless headset 402 is not moving, the movement data can indicate no movement. After receiving movement data from the accelerometer 404, the method 900 can proceed to block 904.

At block 904, audio comprising a combination of a left channel signal and a right channel signal can be mixed based on the detected movement of the wireless headset. For example, the processor 408 can mix the left channel signal and right channel signal based on the detected movement of the wireless headset 402. If there is no detected movement, the processor 408 can mix the output audio signal with a substantially equal balance of left channel signal and right channel signal. For example, the output audio signal can comprise 50% left channel signal and 50% right channel signal. In the event there is detected movement, the processor 408 can mix the output audio signal with an unequal balance of left channel signal and right channel signal. For example, if the detected movement indicates that the wireless headset is moving to the right, then the output audio signal can comprise more left channel signal than right channel signal, for example, 60% left channel signal and 40% right channel signal. After mixing the audio, the method 900 can proceed to block 906.

At block 906, an output audio signal comprising a combination of the left channel signal and the right channel signal based on the detected movement is provided. For example, the processor 408 can output the output audio signal to the single speaker 406. The output audio signal can comprise 60% left channel signal and 40% right channel signal based on the detected movement. As a result, the user can experience dimensional synthetic stereo based on the detected movement of the wireless headset 402. After providing the output audio signal to the single speaker, the method 900 can proceed to block 902, where the method 900 can continue based on the new movement data from the accelerometer.

The system and method described above can provide several benefits to a user of a mobile device 100. For example, the accelerometer 404 can detect movement of the wireless headset 402 and the processor 408 can set an output audio signal comprising a percentage of the left channel signal and a percentage of the right channel. The percentages of the left channel signal and right channel signal can be set based on the detected movement. For example, the left channel signal can gradually move from 50% to 100% and the right channel signal can gradually move from 50% to 0%. As a result, a user can experience synthetic stereo based on the detected movement of the wireless headset 402 using a single or mono speaker 406.

The system and method have the advantage of providing a stereophonic listening effect using only a single speaker 406 coupled to a single ear of a listener. Thus, the other ear of the listener is free to hear local ambient sounds without interference from the audio signal played by the wireless headset 402, thereby allowing conversations with persons in the vicinity, hearing local alerts such as traffic horns or computer beeps, or engaging in a second conversation on a second telephone, all while simultaneously experiencing a stereo effect on the single ear headset 402. The single ear headset 402 can also be used to conduct telephone conversations, as typically accomplished using a Bluetooth® enabled wireless headset 402. While a wireless Bluetooth® embodiment is described, other wired or wireless interfaces between the headset 402 and the mobile device 100 are anticipated within the scope of this disclosure.

Example embodiments have been described hereinabove regarding the implementation of a method and system for adjusting notification settings within a notification module 400 on network operable mobile devices 100. Various modifications to and departures from the disclosed example embodiments will occur to those having skill in the art. The subject matter that is intended to be within the spirit of this disclosure is set forth in the following claims.

What is claimed is:

1. A mono headset comprising:

an accelerometer configured to detect movement of the mono headset; a single speaker; and a processor communicatively coupled to the single speaker and the accelerometer, the processor configured to mix an output audio signal comprising a left channel signal and a fight channel signal and to provide the output audio signal to the single speaker, the output audio signal comprising a combination of the left channel signal and fight channel signal based at least in part on detected movement of the mono headset wherein the processor provides the output audio signal to the single speaker with the output audio signal comprising substantially equal balance of the left channel signal and right channel signal in the event the accelerometer detects a sustained state of no movement.

2. The mono headset of claim 1 wherein the processor sets the output audio component to an unequal balance of left channel signal and right channel signal in the event the accelerometer detects movement of the mono headset.

3. The mono headset of claim 1 wherein the processor sets the output audio signal having more left channel signal than right channel signal in the event the detected movement is to the left and sets the output audio signal having less left channel signal than right channel signal in the event the detected movement is to the right.

4. The mono headset of claim 3 wherein the processor sets the output audio signal having unequal balance of the left channel signal and the right channel signal based on magnitude, direction and duration of the detected movement.

5. The mono headset of claim 3 wherein the processor sets the output audio signal having substantially equal balance of the left channel signal and right channel audio in the event the accelerometer detects the termination of movement, wherein the setting of the output audio signal is set in a decaying unequal balance of the left channel signal and right audio channel until there is a substantially equal balance of the left channel signal and right channel signal.

6. The mono headset of claim 1 wherein the mono headset is a wireless mono headset.

7. A processor implemented method for adjusting audio in a mono headset, the method comprising:

receiving, by a processor, movement data from an accelerometer detecting movement of the mono headset;

mixing, by the processor, of an output audio signal comprising a left channel signal and a right channel signal; and providing, to a single speaker, the output audio signal comprising a combination of the left channel signal and right channel signal based at least in part on detected movement of the mono headset wherein providing the output audio signal to the single speaker comprises providing the output audio signal comprising substantially equal balance of the left channel signal and right channel signal in the event the accelerometer detects a sustained state of no movement.

8. The processor implemented method of claim 7 wherein providing the output audio signal to the single speaker includes comprises providing the output audio signal to an unequal balance of left channel signal and right channel signal in the event the accelerometer detects movement of the mono headset.

9. The processor implemented method of claim 7 wherein providing the output audio signal to the single speaker comprises providing the output audio signal having more left channel signal than right channel signal in the event the detected movement is to the left and sets the output audio signal having less left channel signal than right channel signal in the event the detected movement is to the right.

10. The processor implemented method of claim 9 wherein providing the output audio signal to the single speaker comprises providing the output audio signal having unequal balance of the left channel signal and the right channel signal based on magnitude, direction and duration of the detected movement.

11. The processor implemented method of claim 9 wherein the processor providing the output audio signal to the single speaker comprises providing the output audio signal having substantially equal balance of the left channel signal and right channel audio in the event the accelerometer detects the termination of movement, wherein the output audio signal is a decaying unequal balance of the left channel signal and right audio channel until there is a substantially equal balance of the left channel signal and right channel signal.

12. The processor implemented method of claim 7 wherein the mono headset is a wireless mono headset.

13. A non-transitory computer readable medium storing instructions for configuring a mono headset to execute instructions on a processor to:

receiving movement data from an accelerometer detecting movement of the mono headset;

mixing of an output audio signal comprising a left channel signal and a right channel signal; and providing, to a single speaker, the output audio signal comprising a combination of the left channel signal and right channel signal based at least in part on detected movement of the mono headset wherein providing the output audio signal to the single speaker comprises providing the output audio signal comprising substantially equal balance of the left channel signal and right channel signal in the event the accelerometer detects a sustained state of no movement.

14. The non-transitory computer readable medium of claim 13 wherein providing the output audio signal to the single speaker comprises providing the output audio signal to an unequal balance of left channel signal and right channel signal in the event the accelerometer detects movement of the mono headset.

15. The non-transitory computer readable medium of claim 13 wherein providing the output audio signal to the single speaker comprises providing the output audio signal having more left channel signal than right channel signal in the event the detected movement is to the left and sets the output audio signal having less left channel signal than right channel signal in the event the detected movement is to the right.

16. The non-transitory computer readable medium of claim 13 wherein providing the output audio signal to the single speaker comprises providing the output audio signal having unequal balance of the left channel signal and the right channel signal based on magnitude, direction and duration of the detected movement.

17. The non-transitory computer readable medium of claim 13 wherein the processor providing the output audio signal to the single speaker comprises providing the output audio signal having substantially equal balance of the left channel signal and right channel audio in the event the accelerometer detects the termination of movement, wherein the output audio signal is a decaying unequal balance of the left channel signal and right audio channel until there is substantially equal balance of the left channel signal and right channel signal.

* * * * *